United States Patent [19]

Geraci

[11] Patent Number: 4,743,010

[45] Date of Patent: May 10, 1988

[54] DYNAMIC POWERED ROWING MACHINE

[76] Inventor: Alexander Geraci, 5221 N. Lind Ave., Chicago, Ill. 60630

[21] Appl. No.: 895,137

[22] Filed: Aug. 11, 1986

[51] Int. Cl.[4] ..... A63B 21/00; A63B 69/06

[52] U.S. Cl. ..... 272/72; 272/120

[58] Field of Search ..... 272/72, 125, 116, 126, 272/120, 121, 128, 73, 144, 85, 87, 54, 55, 134

[56] References Cited

U.S. PATENT DOCUMENTS

| | | | |
|---|---|---|---|
| 641,596 | 1/1900 | Kerns | 272/72 |
| 773,170 | 10/1904 | Taylor | 272/72 |
| 1,577,809 | 5/1924 | Randall | 272/72 |
| 1,905,092 | 4/1933 | Hardy | 272/72 |
| 1,982,872 | 10/1934 | Husted | 272/72 |
| 2,642,288 | 6/1953 | Bell | 272/120 |
| 3,411,497 | 11/1968 | Rickey et al. | 272/72 |
| 3,446,503 | 5/1969 | Lawton | 272/120 |
| 4,300,760 | 11/1981 | Bobroff | 272/72 |

*Primary Examiner*—Richard J. Apley
*Assistant Examiner*—S. R. Crow
*Attorney, Agent, or Firm*—Samuel Kurlandsky

[57] ABSTRACT

A rowing machine comprising a base, a rowing arm pivotally mounted at one end to the base, a seat assembly pivotally mounted on the base rearwardly of the rowing arm, a foot pedal assembly pivotally mounted on the base forwardly of the rowing arm, a first connecting arm pivotally connected at one end to the foot pedal assembly at a point spaced above the base and at the other end to the rowing arm at a point spaced above the base, and a second connecting arm pivotally connected at one end to the rowing arm at a point spaced above the base and pivotally connected at the other end to the seat assembly at a point spaced above the base. In operation, as the operator pulls back on the rowing arm, the pedals move back and the seat moves back and up. The upward movement of the seat affords a certain amount of resistance to the operator as he lifts his own weight. Additionally, the operator may utilize his leg power to resist the arm movement of the rowing arm, thereby permitting him to control the amount of resistance to the rowing arm in proportion to the force exerted against the foot pedals.

8 Claims, 2 Drawing Sheets

DYNAMIC POWERED ROWING MACHINE

BACKGROUND OF THE INVENTION

1. Field of the Invention

The present invention relates to an exercise apparatus, and more particularly refers to such an apparatus in the form of a rowing machine.

2. Description of the Prior Art

Rowing machines of many different types have been disclosed in the prior art. Most of such rowing machines have a seat with rollers mounted on a rearwardly accending ramp to provide a resistant force to the operator. Some rowing machines utilize a system of ropes and pulleys with springs for providing pulling resistance. Other rowing machines utilize hydraulic cylinders, generally in the form of automobile shock absorbers for providing resistance to rowing movement. However, rowing machines disclosed in the prior art have several drawbacks. First, they require complicated apparatus units to provide the adequate movement and resistance and adjustment for movement resistance. Moreover, they provide the previously set resistance, thereby making it difficult for the operator to begin his exercise period when he would like to start with only a low resistance force. Further, the rowing machines of the prior art are quite expensive and complicated to build.

SUMMARY OF THE INVENTION

It is an object of the present invention to provide a rowing machine which is easy to operate and adjust.

It is another object of the invention to provide a rowing machine whereby a warm-up period at low resistance may be utilized at the beginning of the exercise period and the resistance subsequently increased after warm-up without the need for physically readjusting the machine.

It is another object to provide a rowing machine which is free of springs and hydraulic devices.

It is still a further object of the invention to provide a rowing machine which is easily fabricated and relatively inexpensive.

It is a further object to provide a rowing machine which does not require assembly after purchase and is always ready to be used, and may be folded flat for easy storage.

A further object of the invention is to provide a rowing machine having excellent structural strength and which will hold up physically over long periods of use.

The forgoing and other objects, advantages and characterizing features will become apparent from the following description of certain illustrative embodiments of the invention, considered together with the accompanying drawings, wherein like reference numerals signify like elements throughout the various figures.

According to the invention, a rowing machine is provided comprising a base, a rowing arm pivotally connected at one end to the base, a seat assembly pivotally connected to the base rearwardly of the rowing arm, a foot pedal assembly pivotally mounted on the base forwardly of the rowing arm, and connecting arms pivotally connecting the foot pedal and the seat assembly to the rowing arm. As the rowing arm is pulled rearwardly the seat moves rearwardly and upwardly providing a certain resistance to movement. Additionally, force applied by the operator's legs to the foot pedal assembly provides additional resistance to movement of the rowing arm which may be controlled by the amount of force applied by the operator's legs. As a result, during the warm-up period only a limited force may be applied to the foot pedals and after warm-up the force against the foot pedals may be increased materially to provide more strenuous exercise.

DESCRIPTION OF THE PREFERRED EMBODIMENTS

Figure 1:
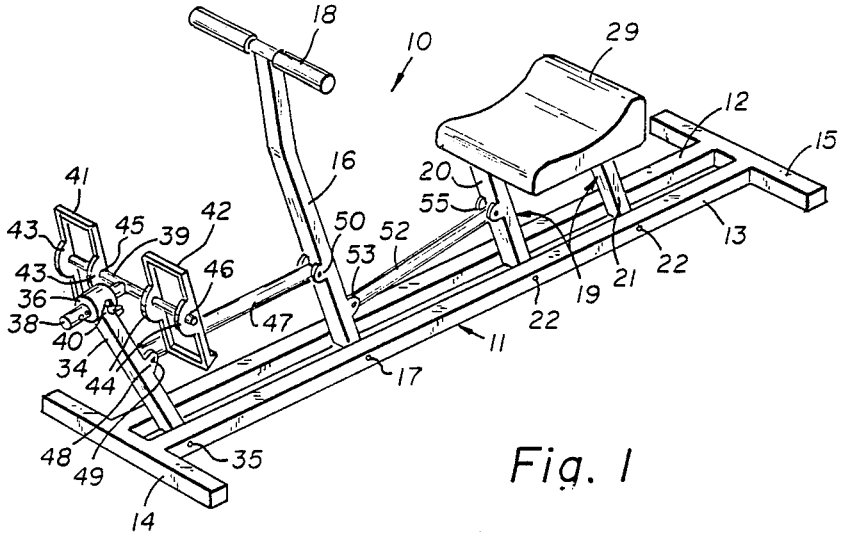
FIG. 1 is a perspective view of the rowing machine of the present invention.
Figure 2:
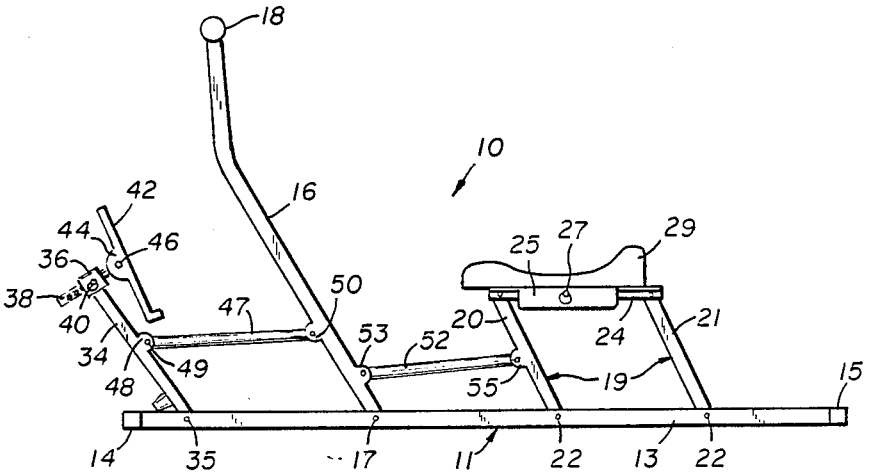
FIG. 2 is a side elevational view of the rowing machine.
Figure 3:
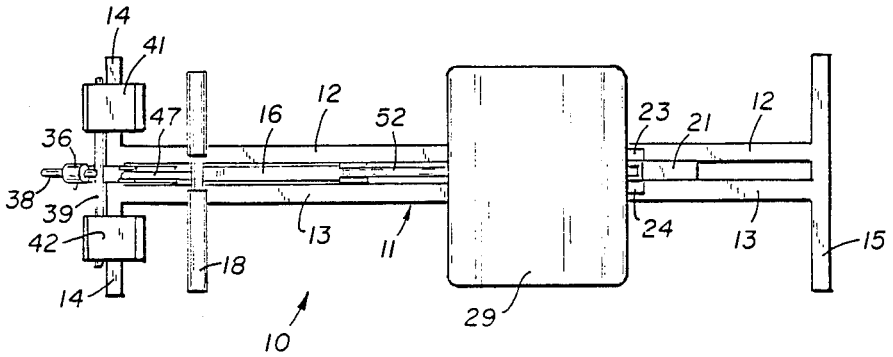
FIG. 3 is a top view of the rowing machine.
Figure 4:
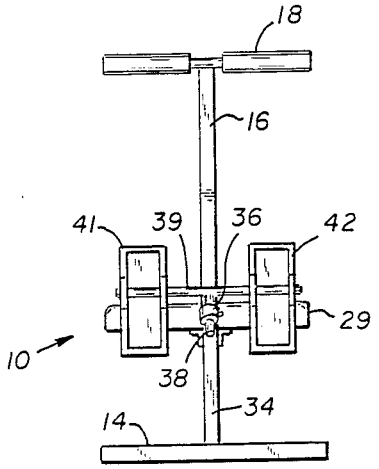
FIG. 4 is an end view of the rowing machine.

Referring to FIGS. 1–4, a rowing machine 10 is shown comprising a base 11 formed of longitudinal bars 12 and 13 and end bars 14 and 15. A rowing arm 16 is pivotally mounted at its end to the bars 12 and 13 by means of a pin 17. A handlebar 18 is mounted at the upper end of the rowing arm 16. A seat support assembly 19 comprises a seat forward arm 20 and a seat rearward arm 21 which are mounted at their ends on the bars 12 and 13 by means of pins 22. Horizontal arms 23 and 24 are affixed to the ends of the forward arm 20 and rearward arm 21 by means of pins. Seat angle members 25 are affixed to the seat 29 by means of bolts. Apertures 31 are provided in the horizontal arms 23 and 24 and in the angle members 25 and 26 for receiving a pin 27 for adjustment of the forward and rearward position of the seat 29.

A foot pedal arm 34 is pivotally mounted on the bars 12 and 13 by means of a pin 35. A socket 36 is provided at the end of the foot pedal arm 34 having an opening receiving a longitudinal rod 38 which has a transverse rod 39 at its end. A set screw 40 is utilized for maintaining the position of the longitudinal rods 38 in adjustment. Pivotally mounted on the transverse rod 39 are a pair of pedals 41 and 42 having flanges 43 and 44 with apertures 45 and 46 through which the transverse rod 39 passes.

A forward connecting arm 47 is pivotally connected at one end to a hinge on the foot pedal arm 34 comprising flanges 48 and having a pin 49 passing through apertures therein and through an aperture in the end of the forward connecting rod 47. The other end of the connecting arm 47 is pivotally connected to a hinge 50 on the rowing arm 16.

A rearward connecting arm 52 is connected at one end to a flange hinge 53 provided on the rowing arm 16 by means of a pin passing through apertures in the hinge and in the end of the connecting arm 52. The rear end of the rearward connecting arm 52 is pivotally connected to the forward seat arm 20 at a flange hinge 55 by means of a pin passing through apertures in the hinge and through the end of the connecting arm 52.

Figure 5:
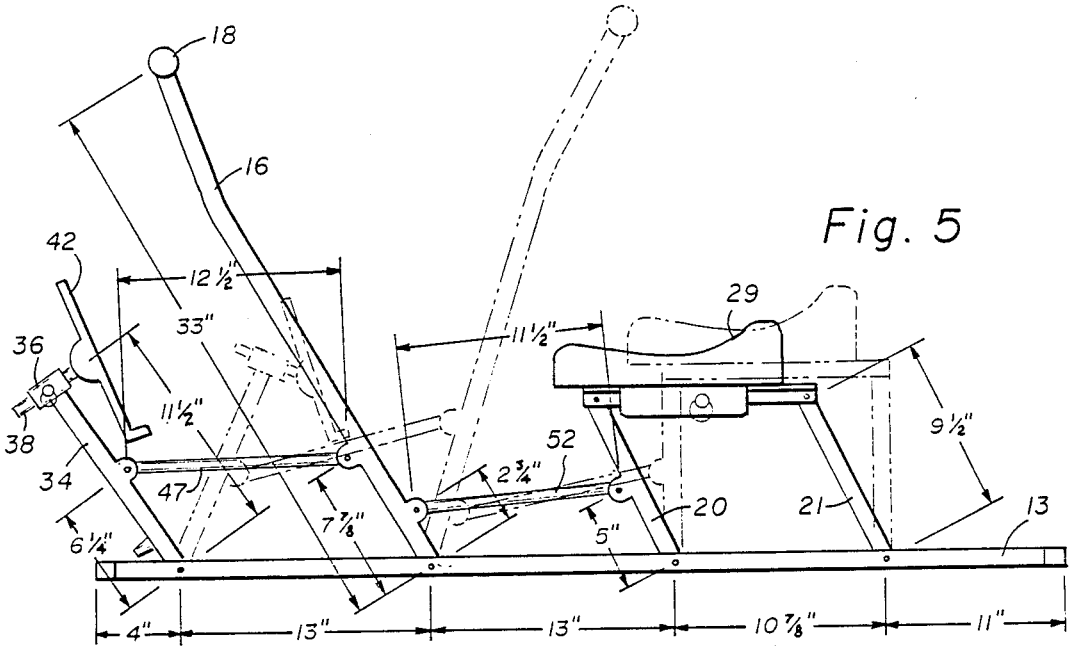
FIG. 5 is a side view showing two positions of the apparatus.

Referring to FIG. 5, two positions of the apparatus are shown. In the position depicted by the solid lines the foot pedals, the rowing arm and the seat are all in a forward position. In the position depicted by the broken lines, the foot pedals, rowing arm and seat are in the rearward position. As can be seen, in the rearward position, the seat is higher than it is in the forward position. As a result, the weight of the operator must be lifted a distance in order to reach the rearward position, thereby overcoming an opposing force. Additional force against the operator's arms is provided by pressure exerted by the operator on the foot pedals. As can be seen in the drawings, in the preferred arrangement, the distance between the pivotal point of the forward connecting arm 47 to the pivot pin 35 is shorter than the distance between the distance from the rear end of the forward connecting arm to the point at which the rowing arm is pivoted on the base. As a result, the pedals move a greater distance than the rowing arm. As can be further seen, the preferred arrangement is such that the distance between the forward end of the rearward connecting arm 52 to the point at which the rowing arm is pivoted on the base is smaller than the distance between the rear end of the rearward connecting arm 52 and the point at which the forward arm 20 of the seat assembly is pivoted. As a result, the seat moves a shorter distance rearward than do the rowing arm and foot pedals. Although this is the preferred arrangement, other relationships may be utilized.

Figure 6:
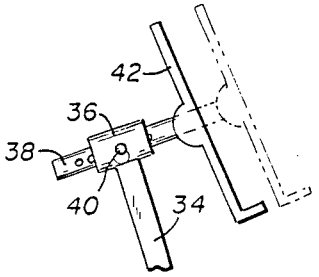
FIG. 6 is a fragmentary view of the apparatus of FIGS. 1–5 showing pedal adjustment in two positions.

FIG. 6 shows various adjustable positions of the foot pedals.

Figure 7:
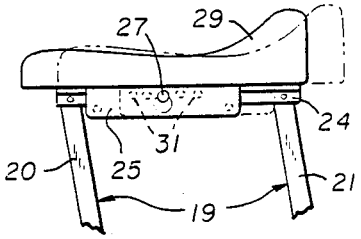
FIG. 7 is a fragmentary side elevational view showing the seat adjustment in two positions.

FIG. 7 shows various adjustable positions of the seat 29. Although such an adjustable seat may be utilized, it has been found that this adjustment mechanism may be dispensed with by utilizing an elongated seat so that the operator can sit in any one of the forward or rearward positions available on the seat.

The rowing machine of the present invention is quite different from rowing machines disclosed in the art and has a number of advantages over them. Unlike prior art rowing machines, in the present machine the pedal, the rowing arm and the seat are all connected together. As the operator pulls back on the rowing arm, the pedals move back and the seat moves back. The upward movement of the seat provides resistance to the operator. The present arrangement also permits the operator to use his leg power. In prior art machines, when the operator wishes to increase or decrease the resistant force, he must stop, dismount from the apparatus, and make an adjustment to the levers or hydraulic cylinder. Normally when the operator begins his rowing exercises, he wishes to warm up while using less resistant force. In prior art machines he must dismount to make the adjustment. Then when he has warmed up, he must dismount again to increase the resistance. In contrast, when the operator wishes to reduce resistance during warm-up with the present apparatus, he need not dismount, but need only to reduce the force applied to the foot pedals by his legs. Subsequently, after he has warmed up, he can increase the resistance applied by his legs without dismounting from the apparatus. No adjustments need be made when changing from a strong operator to a weak operator or vice-versa. The operator need only apply such force as is needed to give him the amount of resistance he desires.

The present apparatus has other advantages. The foot pedals are hinged to allow natural foot positions. The rowing machine is relatively simple in structure and does not have to be knocked down for shipment or reassembled for use. It is ready to be used at all times. It also folds up flat for easy storage. Pedal adjustment is provided to compensate for short or tall people. Additionally, the position of the seat can be changed by a simple adjustment. Alternatively, by using a long seat, the same seat positioning may be utilized by both short and tall people.

As illustrated in the drawings, the linkage distances are so chosen that the pedals move about four times as much as the seat moves, thereby causing the knees to bend. If the pedals were to move at the same rate as the arms and seat, it would not cause the knees to bend.

Referring to FIG. 5, a set of dimensions is shown providing what is believed to be the optimum relationship between the foot pedals, the rowing bar and the seat. Other relationships may be utilized when desired.

Although the invention has been described in connection with specific embodiments thereof, it is evident that many alternatives, modifications, and variations will be apparent to those skilled in the art in the light of the forgoing description and drawings. Accordingly, it is intended to embrace all such alternatives, modifications and variations within the spirit and scope of the invention as defined by the appended claims.

Invention is claimed as follows:

1. An exercising apparatus of the rowing machine type, comprising a base frame, a rowing bar pivotally connected at one end to said base frame and having handle means, a foot pedal assembly shorter than said rowing bar pivotally connected at one end to said base frame at a point forwardly of said rowing bar, a seat assembly pivotally connected to said base frame at a point rearwardly of said rowing bar, a first connecting rod member pivotally connected at one end to said foot pedal assembly at a point spaced above the point at which said foot pedal assembly is pivotally connected to said base frame and pivotally connected at its other end to said rowing bar at a point spaced above the point at which said rowing bar is pivotally connected to said base frame, and a second connecting rod member pivotally connected at one end to said seat assembly at a point spaced above the point at which said seat assembly is pivotally connected to said base frame and pivotally connected at its other end to said rowing bar at a point spaced above the point at which said rowing bar is pivotally connected to said base frame, whereby when said operator pulls rearwardly on said rowing bar, said foot pedal assembly is forced to move rearwardly thereby applying force to the feet of said operator and permitting said operator to apply a counter foot force to increase the force required to move said rowing bar, and whereby said seat assembly is caused to move rearwardly and upwardly, thereby raising said operator and further increasing the force required to pull said rowing bar rearwardly.

2. An exercising apparatus according to claim 1, wherein said seat assembly comprises a pair of substantialy parallel rod members each pivotally mounted at one end on said base frame and at the other end on a seat support having a seat mounted thereon.

3. An exercising apparatus according to claim 2, wherein said seat assembly is adjustably mounted on said seat support

4. An exercising apparatus according to claim 1, wherein said foot pedal assembly comprises a bar member pivotally connected at one end to said base frame and has foot pedals mounted at the other end.

5. An exercising apparatus according to claim 4, wherein said foot pedals are adjustably mounted.

6. An exercising apparatus according to claim 1, wherein said base frame comprises a pair of parallel spaced-apart rods having transverse rods connected to the ends thereof.

7. An exercising apparatus according to claim 1, wherein said base frame comprises a pair of substantially parallel rods connected together having their ends extending laterally for support.

8. An exercising apparatus according to claim 1, wherein when said rowing bar is moved, said foot pedal assembly moves longitudinally a greater distance than said seat assembly, thereby causing flexing of the legs of the operator.

* * * * *